US008627986B2

(12) United States Patent
Bradbury et al.

(10) Patent No.: US 8,627,986 B2
(45) Date of Patent: Jan. 14, 2014

(54) SPRAY DEVICE

(75) Inventors: Glenn Allen Bradbury, Mason, OH (US); Richard Michael Girardot, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 177 days.

(21) Appl. No.: 13/209,728

(22) Filed: Aug. 15, 2011

(65) Prior Publication Data

US 2013/0043329 A1 Feb. 21, 2013

(51) Int. Cl.
*B05B 9/04* (2006.01)

(52) U.S. Cl.
USPC ..... 222/402.11; 222/402.13; 222/518; 222/470; 222/475; 222/635; 239/302

(58) Field of Classification Search
USPC ..... 222/402.13, 402.15, 402.1, 402.11, 222/402.12, 635, 182, 183, 153.11, 222/470–475, 630, 637, 511, 518; 239/302, 239/375, 525, 526
See application file for complete search history.

(56) References Cited

U.S. PATENT DOCUMENTS

| | | | | |
|---|---|---|---|---|
| 3,858,762 | A * | 1/1975 | Meshberg | 222/180 |
| 5,904,273 | A * | 5/1999 | Aspacher et al. | 222/402.15 |
| 6,866,165 | B2 | 3/2005 | Heathcock et al. | |
| 7,007,338 | B2 | 3/2006 | Garabedian, Jr. et al. | |
| 7,121,435 | B2 | 10/2006 | Brody | |
| 8,052,015 | B2 * | 11/2011 | Huang | 222/402.15 |
| 2009/0045223 | A1 * | 2/2009 | Laidler et al. | 222/108 |

* cited by examiner

*Primary Examiner* — J. Casimer Jacyna
(74) *Attorney, Agent, or Firm* — Larry L. Huston; Steven W. Miller

(57) ABSTRACT

A device for spraying contents from a pressurized container. The device has an anti-pre-spray mechanism which prevents inadvertent actuation or spray when a new container is loaded into the device. The anti-pre-spray mechanism provides a dead band between a valve assembly in the pressurized container and an actuation mechanism. The dead band may comprise a gap, spring, etc. The actuation mechanism may be activated by the consumer at the point of use.

8 Claims, 4 Drawing Sheets

SPRAY DEVICE

FIELD OF THE INVENTION

The present invention relates to devices for spraying a fluid from a pressurized container, and more particularly devices having an anti-pre-spray mechanism.

BACKGROUND OF THE INVENTION

Dispensers for spraying, or otherwise dispensing, fluids are well known in the art. The dispensers may comprise a container having fluid therein and being pressurized relative to atmospheric pressure. The pressurization can be provided by a manual pump, such as a trigger sprayer. Alternatively, pressurization can be provided by the propellant of an aerosol container.

The dispensers are often used in conjunction with a device to provide more convenient spraying. Such devices may be used to reach the floor, as disclosed in U.S. Pat. Nos. 6,866,165 B2 and 7,007,338 B2. Other devices are used in a hand-held configuration, as disclosed in U.S. Pat. No. 7,121,435 B2.

One problem associated with such devices is unintended spraying from the dispenser when it is first inserted into the device. For example, if an aerosol container is selected as the dispenser, the contents are under pressure. If the user needs to replace a depleted aerosol container, he/she must first remove that aerosol container from the device. When a new aerosol container is inserted into the device, inadvertent actuation may occur as the aerosol pressure is still present—and at its maximum. If the device is dropped, undesired dispensing may occur upon impact with the floor.

Attempts to overcome this problem have not been entirely successful. For example, the aforementioned '165 patent relies upon an over cap which opens a valve when moved by a rod link to a remote trigger. This is a costly and complex mechanism. Further, the over cap is an extraneous element not necessary for operation. Accordingly, further improvements are needed.

SUMMARY OF THE INVENTION

The invention comprises a device for receiving material in and dispensed material from a container. The container has a nozzle for dispensing contents of the container through a valve assembly. The device has a valve actuation mechanism movable from a first position in which dispensing does not occur, to a second position in which dispensing does occur. A dead band separates the actuation mechanism and valve assembly in the first position, thereby preventing undesired dispensing.

DETAILED DESCRIPTION OF THE INVENTION

Figure 1A:
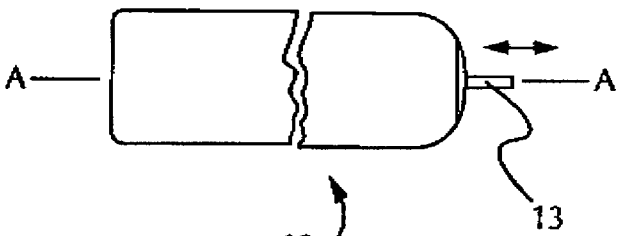
FIG. 1A is a side elevational view of a container usable with the device of FIG. 1.
Figure 1:
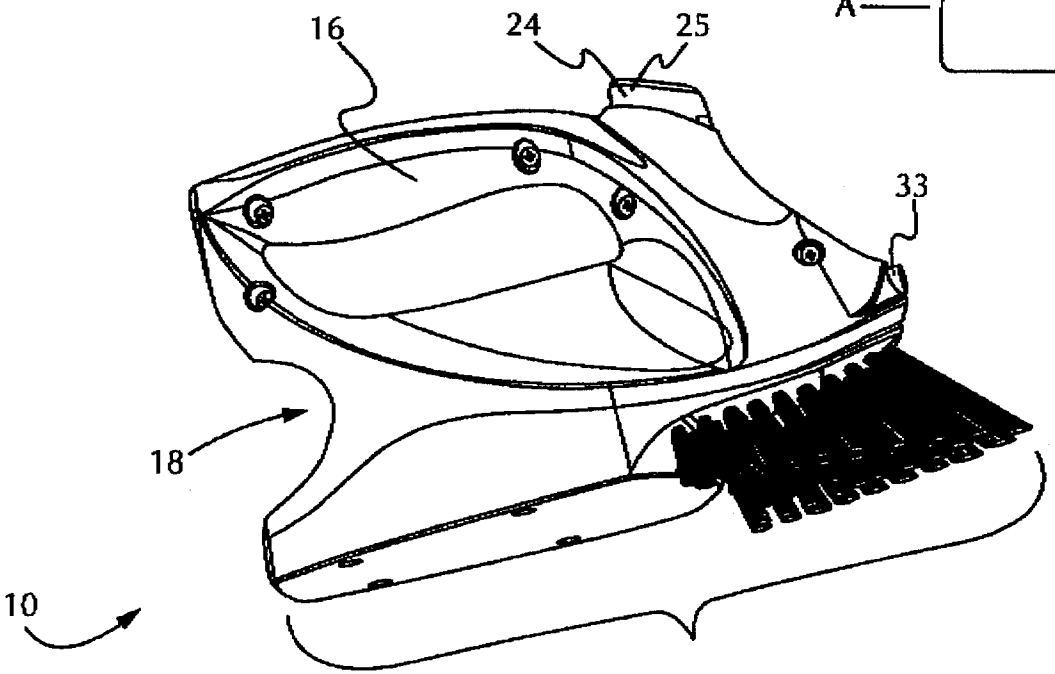
FIG. 1 is a perspective view of a device according to the present invention.

Referring to FIGS. 1 and 1A, the device 10 comprises a receptacle 18 for receiving one or more pressurized or pressurizable containers 12. The container 12, and fluid therein, may be pressurized by an aerosol, a trigger pump or other manual pump, expandable elastomeric containers 12, etc.

The container 12 may contain dispensable contents, such as a fluid and/or materials dispensable as a fluid. Exemplary fluids include air, food stuffs, mousse, cleanser, furniture polish, shaving cream, foam, gel, paint and other surface treatments, etc. and do not comprise part of the present invention. Materials dispensable as a fluid are included herewith as fluid and may include farinaceous materials, granular powders, etc. The dispensable materials may contain optional ingredients such as perfumes, disinfectants, etc.

The device 10 may have a base for convenient placement on a countertop or table. The device 10 may optionally further comprise a treatment surface 14 for treating a target surface such as a countertop, bathtub, tile, floor, tabletop, etc. If desired, the treatment surface 14 may be coincident the base of the device 10.

The treatment surface 14 of the device 10 may comprise reusable and/or replaceable components. The reusable components may comprise bristles as shown. The bristles may be homogeneous in density, length, structure and stiffness, or, alternatively, the bristles may differ in one or more of these properties as desired. If desired, the treatment surface 14 may come to a point, as shown, to reach into corners.

The treatment surface 14 may optionally further comprise replaceable components such as a nonwoven sheet, a scrubby, a polymeric scrubbing strip, a cellulosic sheet, foam and combinations thereof. The treatment surface 14 may be infused or impregnated with cleanser, surfactants, and/or other devices 10 to be intermixed with the fluid from the container 12 at the point of use.

A suitable replacement component for the treatment surface 14 has been found to be a laminate of two nonwoven sheets and a foam pad therebetween. The foam may comprise polyurethane, melamine, and combinations thereof. The nonwoven may comprise polyethylene, polyester, other synthetic/cellulosic materials, and blends thereof as is known in the art. The replaceable pad may be replaceably joined to the device 10 using adhesive, grippers, mechanical latch 42es, hook and loop fasteners, etc., as are well known in the art.

The device 10 may comprise a handle 16 for convenient ergonomics and manipulation during use and when replacing a depleted container 12 with a fresh container 12. The device 10 may have an actuator 24, such as a button 25, built into, or juxtaposed with, the handle 16 for selective actuation at the point of use by the consumer. Upon actuation of the actuator 24, fluid from the container 12 may be sprayed through a nozzle 33. Such a device 10 may be made according to the teachings of commonly assigned U.S. application Ser. No. 12/911,932, filed Oct. 26, 2010.

The device 10 further comprises an anti-pre-spray mechanism 20. The anti-pre-spray mechanism 20 may be operatively associated with the receptacle 18 and/or the actuator 24. The handle 16, receptacle 18, anti-pre-spray mechanism 20 and base may be connected by a frame. The frame may be integral or comprise multiple pieces joined together.

Figure 2A:
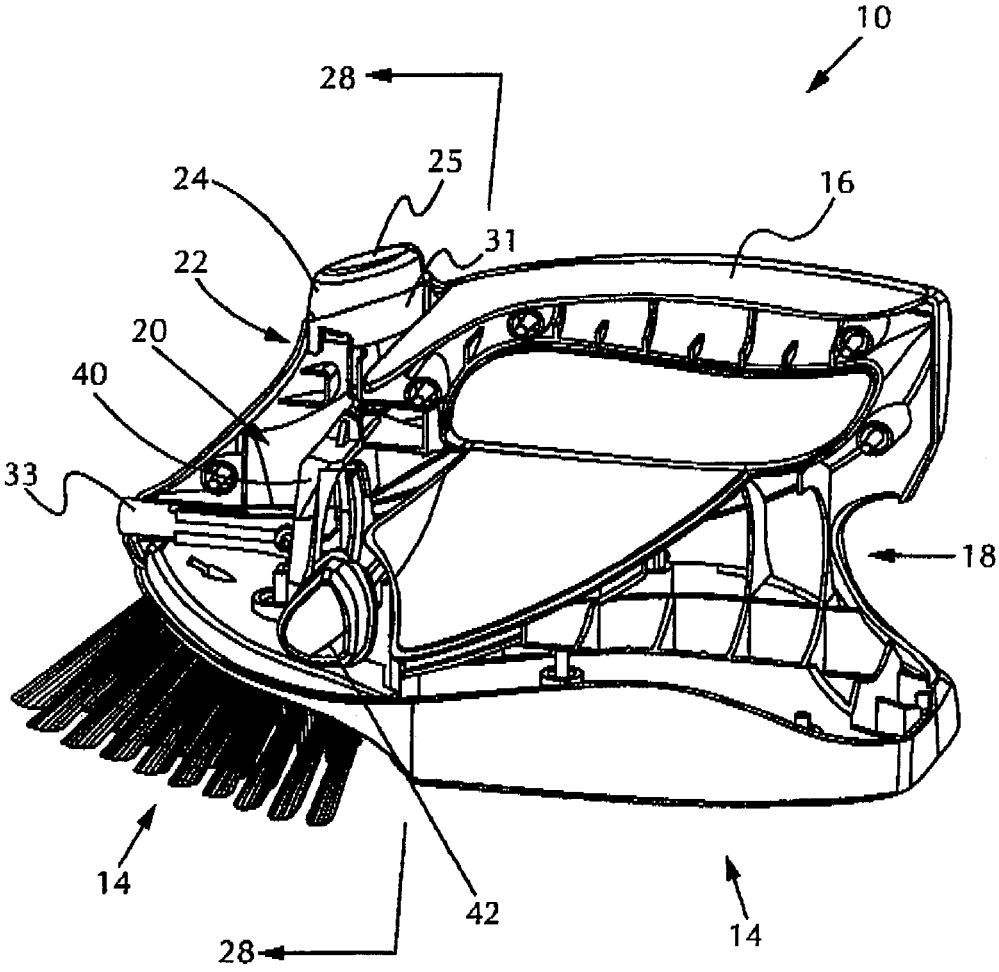
FIG. 2A is a side perspective view of the device of FIG. 1, shown partially in cutaway.
Figure 2B:
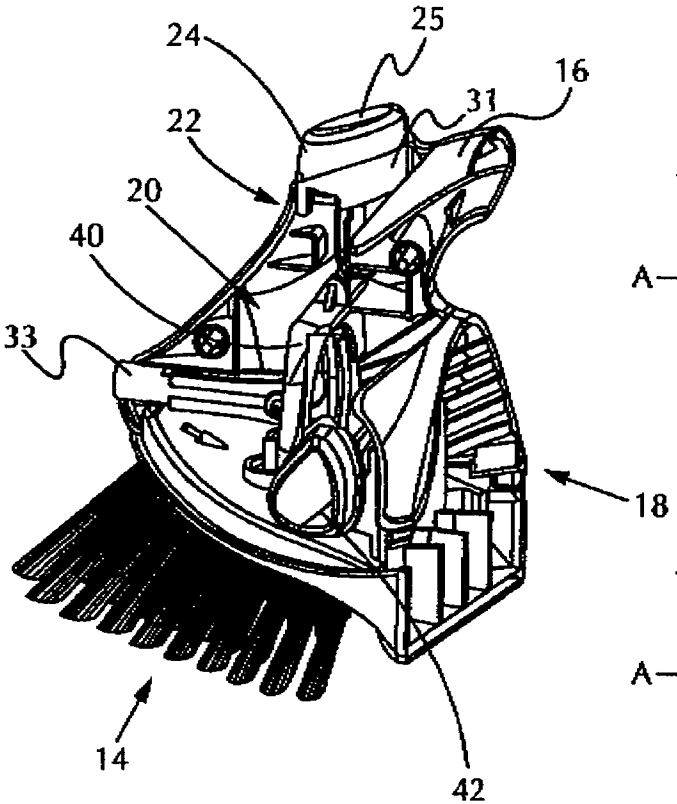
FIG. 2B is sectional view of the device of FIG. 2A, taken along line 2B-2B.
Figure 2C:
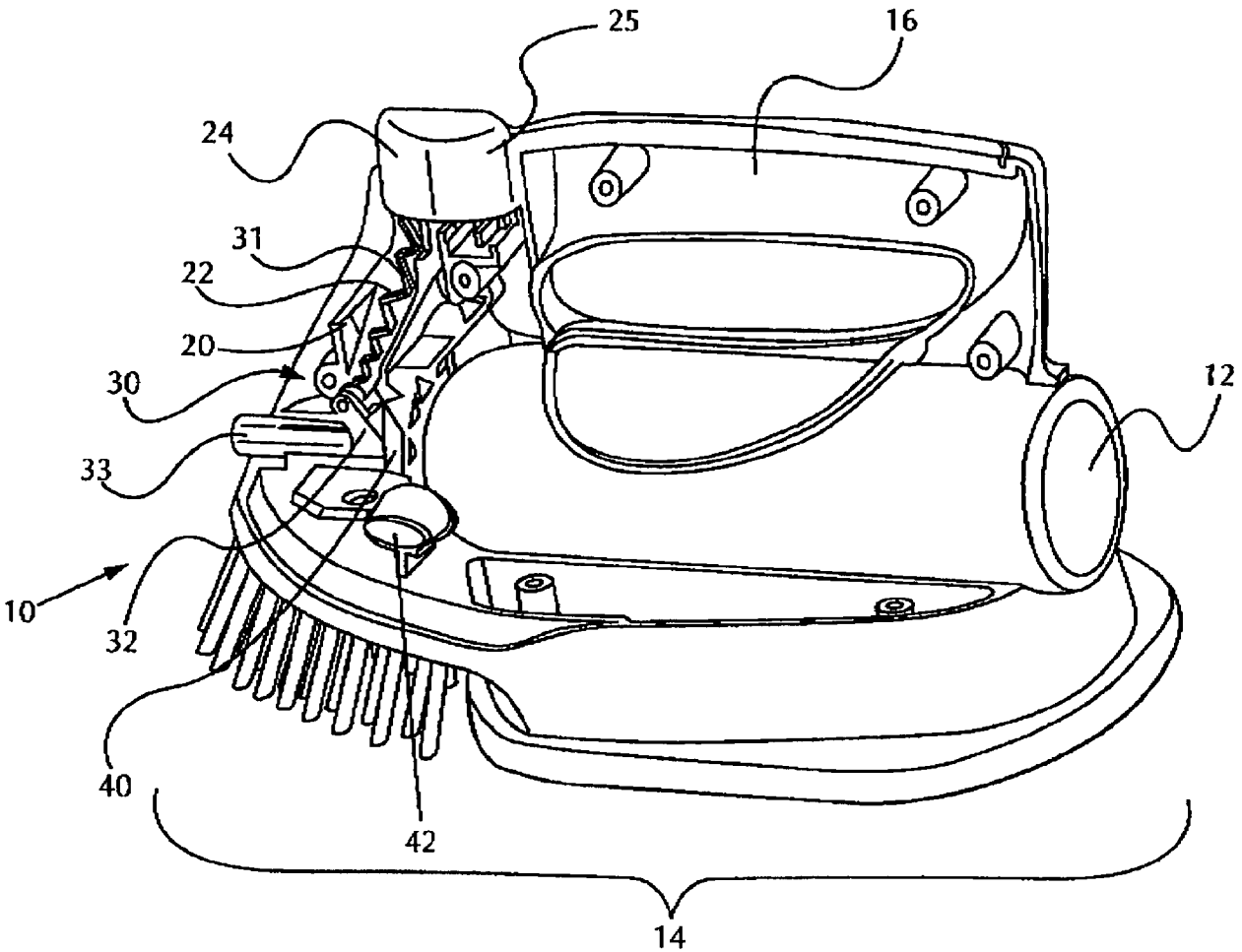
FIG. 2C is a is a side perspective view of the device of FIG. 1, shown partially in cutaway and having an alternative latch assembly, and container inserted in the receptacle of the device.

Referring to FIGS. 2A, 2B and 2C and examining the components in more detail, the handle 16 may form a closed loop as shown, or, alternatively, may be cantilevered, etc. If desired, the handle 16 may be hollow to hold additional cleaning fluid, or other supplies related to the intended cleaning task(s). The handle 16 may be disposed opposite the treatment surface 14 or may be juxtaposed relatively closer to the treatment surface 14.

A manual actuation mechanism 22 is provided. The actuation mechanism 22 allows the consumer to selectively dispense fluid from the container 12, as desired, at the point of use. The actuation mechanism 22 comprises an actuator 24. The actuator 24 is the component of the device 10 which the user interacts with to control dispensing. I.e. by manually actuating the actuator 24, the actuation mechanism 22 is manipulated from a first position, i.e an at-rest position, where dispensing does not occur, to a second position where dispensing does occur. While a push button 25 actuator 24 is shown, one of skill will recognize the actuator 24 is not so limited. A suitable actuator 24 may comprise a knob, rotatable crank, trigger, switch, etc.

The actuation mechanism 22 may be power assisted by pneumatics, hydraulics, electric power, etc. as desired. The discussion below simply utilizes a push button 25 actuator 24 and linkage 30 as an exemplary, non-limiting example of an actuation mechanism 22, although one of skill will recognize the invention is not so limited.

The actuation mechanism 22 interacts with the container 12 of fluid. The reservoir of the container 12 may contain a predetermined amount of contents to be fluidically dispensed from the container 12. Upon depletion, the container 12 may be removed and replaced with a new container 12 of fluid. Alternatively, the container 12 may remain within the device 10 and simply be refilled.

The container 12 of fluid may comprise a movable valve assembly 13 as is well known in the art and which does not form part of the present invention. Displacement of the valve assembly 13 relative to the container 12 reservoir releases fluid or a fluid/aerosol mixture from the pressurized container 12 to the atmosphere through displacement of the valve assembly 13. Displacement may occur parallel to, or in angular relationship with, the container 12. Part of the function of the actuation mechanism 22 is to provide relative displacement of the valve assembly 13 of the pressurized container 12.

The container 12 may have a tapered or otherwise variable cross-section, or may have a constant cross section. Particularly, the container 12 may have a narrower shoulder and/or neck as the valve assembly 13 is longitudinally approached.

The container 12 may be received in a receptacle 18 within the device 10. The receptacle 18 may have a longitudinal axis A-A, corresponding to the longitudinal axis A-A of a pressurized or pressurizable container 12 to be received therein. The container 12 may be pressurized with aerosol, a hand pump, trigger pump, etc. as are well known in the art. Pressurization of the container 12 results in like pressurization of the fluid thereon.

While a generally cylindrical receptacle 18 is shown, one of skill will recognize the invention is not so limited. A receptacle 18 having any geometry suitable for receiving a complimentary container 12 of fluid may be utilized.

The longitudinal axis A-A of the receptacle 18 may be parallel to the treatment surface 14 of the device 10 and/or the longitudinal axis A-A of the handle 16, if the handle 16 is provided. Alternatively, the longitudinal axis A-A of the receptacle 18 may be skewed relative to the treatment surface 14 of the device 10. For example, the longitudinal axis A-A may be oriented so that the valve assembly 13 of the container 12 points slightly towards the target surface, if a particular spray pattern is desired. Alternatively, the fluid may be sprayed, or otherwise dispensed, through one or more apertures in the treatment surface 14 of the device 10.

In the particular case of a generally cylindrical aerosol container 12, the receptacle 18 may be from 100 to 200 mm long, particularly 150 mm long, and from 30 to 60 mm in diameter, particularly 45 mm diameter, if a round cross section receptacle 18 is utilized.

Optionally, the device 10 may further comprise a latch 42. The latch 42 may be disposed at the shoulder of the container 12, the end of the receptacle 18 opposite the actuation mechanism 22 or may be juxtaposed with or integrated with the actuation mechanism 22. The optional latch 42 may secure the fluid container 12 in place, to prevent the container 12 from becoming loose during operation, or from undesired movement in response to user actuation.

Referring to FIGS. 2A, 2B and 2C and examining the device 10 in more detail, the device 10 may comprise a stop 40. The stop 40 may be juxtaposed with the receptacle 18 and/or integral with the frame. The stop 40 limits insertion of a container 12 to a predetermined position within the device 10. The stop 40 may comprise a collar, as shown. The collar may circumscribe the neck of the container 12 when the container 12 is inserted into the receptacle 18. This arrangement provides the benefit that relatively equal force is applied around the container 12 neck, minimizing misalignment or the chance of puncturing the container 12.

However, one of skill will recognize the invention is not so limited. The stop 40 may comprise one or more pegs, blocks, springs 50 which resist undesired and excessive insertion or other mis-placement of the container 12, which prevent the container 12 from being inserted too far into the receptacle 18 or otherwise being disposed in an undesired position within the device 10. The stop 40 provides for proper placement of the container 12 upon insertion into the receptacle 18, even for a user with limited manual dexterity.

When the container 12 is properly inserted, a dead band exists between the valve assembly 13 of the container 12 and the actuation mechanism 22 of the device 10. This dead band prevents displacement of the valve assembly 13 relative to the container 12. By avoiding relative displacement of the valve assembly 13 with respect to the reservoir of the container 12, undesired and inadvertent spraying of the fluid is avoided during changeover from a depleted container 12 to a fresh container 12 or during addition of fluid to a container 12 reservoir within the device 10.

As used herein, a dead band refers to a space through which one or both of the actuation mechanism 22, and particularly the nozzle 33, or other final link thereof, and/or the valve assembly 13 may move relative to one another. Within the dead band, no dispensing occurs. When movement of the nozzle 33, final link, and/or the valve assembly 13, relative to the other reaches the end of the dead band, the actuation mechanism 22 is in the second position. In the second position, dispensing of pressurized contents of the container 12 occurs.

In one embodiment, the dead band may comprise a gap G between the actuation mechanism 22, particularly the nozzle 33 and the valve assembly 13. The actuation mechanism 22 overcomes the gap G between the actuation mechanism 22 of the device 10 and the valve assembly 13 of the container 12, as selectively desired by the user. When the gap G is overcome, it diminishes to zero. After the gap G is completely overcome, displacement of the valve assembly 13 relative to the balance of the container 12 may occur. The container 12 may remain stationary while the valve assembly 13 moves relative thereto, or vice versa. Likewise, the actuation mechanism 22 nozzle 33 may move relative to the valve assembly 13, or vice versa.

Upon reaching the second position, the actuation mechanism 22 may displace the valve assembly 13 in response to actuation of the button 25 having manually occurred by the user. Any suitable linkage 30 or elements inter-connecting the button 25 and valve assembly 13 may be utilized. The actuation mechanism 22 provides for relative movement between the nozzle 33 and the valve assembly 13.

The valve assembly 13 is associated with the container 12 and need not comprise part of the claimed device 10. The valve assembly 13 may translatably move in known rectilinear fashion. Particularly, the valve assembly 13 may compress into the container 12 to effect dispensing as is known in the art. Alternatively or additionally, the valve assembly 13 may articulate in curvilinear fashion to effect dispensing as is known in the art.

For example, when the user depresses the button 25 in a first direction, a first link 31 may be rigidly joined thereto and move a comparable or identical distance in the first direction. The first link 31 may have a first end rigidly or pivotally joined to the button 25, or other actuator 24. The first link 31 may have a second end remote from the first end. The second end may be pivotally connected to a second link 32.

The second link 32 may likewise have a first end, pivotally connected to the second end of the first link 31. The second link 32 may have a second end remote from the first end. The second end of the second link 32 may be pivotally joined to the nozzle 33.

The second link 32 moves in response to movement of the first link 31. The second link 32 may cause corresponding movement of the nozzle 33. The nozzle 33 may act as the third, and final, link of this linkage 30, and may function to dispense fluid from the container 12.

Figure 4:
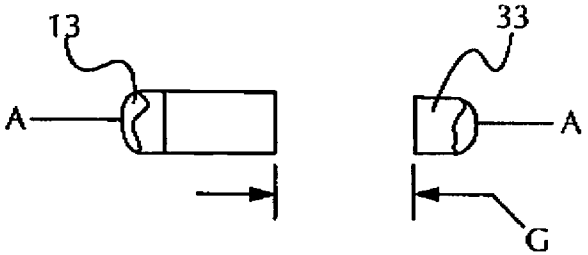
FIG 4. is an exemplary embodiment of a dead band comprising a gap.

Referring to FIG 4, the nozzle 33 may move through the distance of the gap G or other dead band. After moving through the gap G, the nozzle 33 may incipiently contact the valve assembly 13. Further movement of the valve assembly 13 causes relative displacement between the valve assembly 13 and the balance of the container 12. The container 12 may remain in fixed position in the receptacle 18. If so, the valve assembly 13 may move in relationship to the container 12, allowing and causing dispensing of the fluid therefrom.

One or more of the button 25, first link 31, second link 32 and/or nozzle 33 (an effective third link) may be spring 50 biased to return to the first position. The first position is the initial position of the actuation mechanism 22 without consumer actuation and which does not allow or cause dispensing to occur. The user depresses, or otherwise moves, the button 25, and the first link 31 in response thereto, the second link 32 in response to movement of the first link 31, the nozzle 33 in response to movement of the second link 32, and ultimately the valve assembly 13 in response to movement of the nozzle 33. Particularly, the nozzle 33 may move through the gap G, or other dead band, and into contact with the valve assembly 13. Further depression of the button 25 causes the valve assembly 13 to move to a second position. The second position may be considered any position which allows and causes dispensing to occur.

The dispensing mechanism may be considered to translate motion of the button 25 in a first direction to motion of the second link 32, nozzle 33 and/or valve assembly 13 in a second direction lateral to the first direction. The first direction and second direction may form an included angle therebetween ranging from 100-160 degrees, particularly 134 degrees, when the actuation mechanism 22 is in the first, non-actuated position and 70 to 130 degrees, particularly 102 degrees, in the second, actuated position. In a degenerate case, the second direction may be perpendicular to the first direction. Thus, the included angle may decrease during actuation.

If desired, plural second links 32 may be utilized in parallel. For example, two plural second links 32 may be pivotally connected to the nozzle 33 at 180° apart. The plural second links 32 may be connected by a yoke. The yoke may be centrally and pivotally connected to the first link 31. This arrangement provides the benefit that movement of the nozzle 33 in the second direction occurs parallel to the longitudinal direction of the container 12 and valve assembly 13. Thus, chances for misalignment and improper dispensing are reduced.

The gap G, or other dead band, between the nozzle 33 and valve assembly 13 may range from 0.5 to 8 mm, or 1-4 mm and may particularly be 1 mm. The gap G is measured in the direction of movement of the nozzle 33. The nozzle 33 may translate throughout displacement from a first position to a second position a distance of 1 to 5 mm, and may particularly translate 3 mm. The initial movement of the nozzle 33 through the gap G provides incipient contact of the actuating mechanism with the valve assembly 13. Further movement of the actuating mechanism, and of the nozzle 33 in response thereto, causes displacement of the valve assembly 13, resulting dispensing of contents from the container 12.

Figure 3:
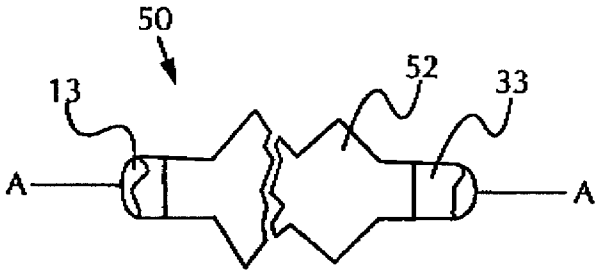
FIG. 3 is an accordion compression spring, usable to overcome the dead band of the present invention.

Referring to FIG. 3, in another embodiment the dead band may comprise a compression spring 50. The compression spring 50 may comprise an accordion 52 spring 50 as shown, a coil spring 50, conical spring 50 washer, etc. as is known in the art. The spring 50 may be compressed by relative movement between the nozzle 33 and/or valve assembly 13. When sufficient compression of the spring 50 occurs, the valve assembly 13 will move from its first position to its second position and dispensing will occur.

In yet another embodiment, the dead band may comprise a telescoping assembly. The telescoping assembly may likewise compress, or otherwise longitudinally shorten, in response to actuation of the actuation mechanism 22 by the user. Such actuation likewise moves the telescoping assembly from the first position, through the dead band with no dispensing, to the second position, where dispensing occurs.

The gap G, compression spring 50 and/or telescoping assembly may be used alone or in any combination to form the dead band. Again, dispensing does not occur until the dead band is overcome and the second position is reached. One of skill will recognize the actuation mechanism 22 of the device 10 and the valve assembly 13 of the container 12 each have a first position where dispensing does not occur, a second position where dispensing does occur and a dead band therebetween. Again dispensing does not occur in the dead band. Dispensing only occurs when the space of the dead band is overcome by relative rectilinear movement and/or relative curvilinear movement between the valve assembly 13 and actuation mechanism 22 towards one another.

Referring back to FIGS. 2A, 2B and 2C, the aforementioned arrangement provides the benefit that the nozzle 33 may be permanently associated with the device 10. Accordingly, it is not necessary for a nozzle 33 to be provided with each refill of the container 12. By utilizing a single nozzle 33 associated with the device 10, the cost of providing a new nozzle 33 each time the container 12 is replenished is avoided.

If desired, the device 10 and refills therefor may be sold as a kit. Plural refill containers 12 may be provided, minimizing the packaging associated with individual refills. Furthermore, by providing a device 10 and refill together as a kit, the consumer is assured that the proper refill has been selected and improper fitting or having a refill not otherwise complementary to the device 10 are avoided. The kit may contain one or more containers 12 of identical fluid. If plural fluid containers 12 are selected, the containers 12 may contain fluids incompatible until mixed at the point of use. Alternatively, the kit may contain plural containers 12 having a variety of fluids. For example, the fluids may have different scents, disinfectants, intended target surfaces, etc.

Thus, the present invention provides the unpredicted and dual benefits of simple ergonomics with automatic prevention of inadvertent spraying during changeover. No specific action or additional preventive action on behalf of the consumer is required to prevent undesired spraying during changeover. A specific preventive action may be forgotten if the consumer is in a hurry or skipped if the preventive action is otherwise inconvenient to perform. In either situation, undesired spraying may occur.

If undesired spaying occurs during changeover of the container 12, the liquid of the undesired spray may impinge upon an incompatible target surface, a person's skin or face, etc. Thus, an automatic anti-pre-mechanism 20 provides benefits not taught by or predicted in the art.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for spraying fluid therefrom, said device comprising:

a receptacle, said receptacle being able to removably receive pressurizable fluid therein;

a container having a valve assembly translatably displaceable in response to actuation by a user, whereby upon actuation fluid is dispensed from said container;

an actuation mechanism, said actuation mechanism being selectively activatable by user from a first position in which dispensing does not occur, to a second position in which dispensing does occur; said actuation mechanism comprising a button selectively depressible in a first direction to move said actuation mechanism from said first position to said second position wherein said actuation mechanism comprises a first link, said first link having a first end joined to said button and a second end remote therefrom, said second end of said first link being pivotally connected to a second link, said second link having a first end pivotally connected to said second end of said first link and a second end remote therefrom, said second end of said second link being pivotally joined to a nozzle, to cause displacement thereof in response to actuation of said button, said nozzle moving in response to movement of said second link, which, in turn, moves in response to movement of said first link, which, in turn, moves in response to depression of said button; and a dead band intermediate said actuation mechanism and said valve assembly;

whereby said actuation mechanism moves from said first position, through said dead band, to a second position whereupon in said second position said actuation mechanism contacts and displaces said valve assembly in a second direction to thereby dispense fluid therefrom in response to selective actuation by the user, said first direction and said second direction being non-parallel to each other.

2. A device according to claim 1 wherein said actuation mechanism is translatably displaceable through a gap.

3. A device according to claim 2 wherein said gap ranges from 1 to 4mm.

4. A device according to claim 1 wherein said dead band comprises a compression spring intermediate said actuation mechanism and said valve assembly.

5. A device according to claim 4 wherein compression spring comprises an accordion spring.

6. A device according to claim 4 wherein said container comprises an aerosol container.

7. A device according to claim 6 further comprising a latch to selectively and removably hold said aerosol container in said receptacle.

8. A device according to claim 1 wherein said container further comprises a shoulder, and a stop circumscribing said shoulder and abutting said container when said container is received in said receptacle.

* * * * *